United States Patent [19]

Dittmann

[11] 3,937,548

[45] Feb. 10, 1976

[54] DEVICE FOR SPLICING WIRE

[75] Inventor: Larry Eugene Dittmann, Harrisburg, Pa.

[73] Assignee: AMP Incorporated, Harrisburg, Pa.

[22] Filed: Feb. 26, 1975

[21] Appl. No.: 553,389

[52] U.S. Cl. ..... 339/95 D; 339/260
[51] Int. Cl.[2] ..... H01R 11/04
[58] Field of Search ..... 339/95 R, 95 D, 260

[56] References Cited

UNITED STATES PATENTS

| | | | |
|---|---|---|---|
| 1,724,729 | 8/1929 | Ruttenberg | 339/260 |
| 3,596,229 | 7/1971 | Hohorst | 339/95 D |

FOREIGN PATENTS OR APPLICATIONS

| | | | |
|---|---|---|---|
| 547,198 | 8/1942 | United Kingdom | 339/95 D |
| 1,292,714 | 4/1969 | Germany | 339/95 D |

*Primary Examiner*—Roy Lake
*Assistant Examiner*—Mark S. Bicks
*Attorney, Agent, or Firm*—Allan B. Osborne, Esquire

[57] ABSTRACT

This invention relates to a device for splicing two wires together whereby such splice can be disconnected and the device reused. More particularly the invention provides a single elongated housing of insulating material and a one piece contact strip encased therein. The strip contains a spring member and apertured frames which receive the wire conductors. Upon forcing depressed steps on the strip into slots in the housing the apertures are deformed into electrical and mechanical contact with the conductors. The spring member retains the force thereon until release by means of a releasing tool.

1 Claim, 3 Drawing Figures

DEVICE FOR SPLICING WIRE

BACKGROUND OF THE INVENTION

Prior art devices similar to the one disclosed herein are generally of the type wherein a free end of a strip of conductive material extends obliquely in towards the center of the housing in which it is positioned. The free end can rotate over a limited arc and further is generally longer than the height of the housing. As a wire is pushed into the housing from an opened end the free end of the strip is pushed or rotated out of the way but as the wire is then backed off a short distance, the free end is dragged along with its edge biting into the wire. Releasing the wire from this type of prior art splice device requires some degree of dexterity. First the wire must be pushed back into the housing as far as it can be. A tool such as a screwdriver is then inserted in between the wire and free end of the strip of metal. While the edge is thus held out of the way, the wire is withdrawn.

Accordingly, the object of the present invention is to provide a device for splicing two wires together which is easy to manipulate yet provides a positive electrical contact.

Another object of the present invention is to provide a device for splicing electrical wires together which provides a positive mechanical retention.

Yet another object of the present invention is to provide a device which is simple to use and is economical.

These and other objects, advantages and novel features of the present invention will be readily apparent from the following description of the preferred embodiment.

DESCRIPTION OF THE PREFERRED EMBODIMENT

Figure 1:
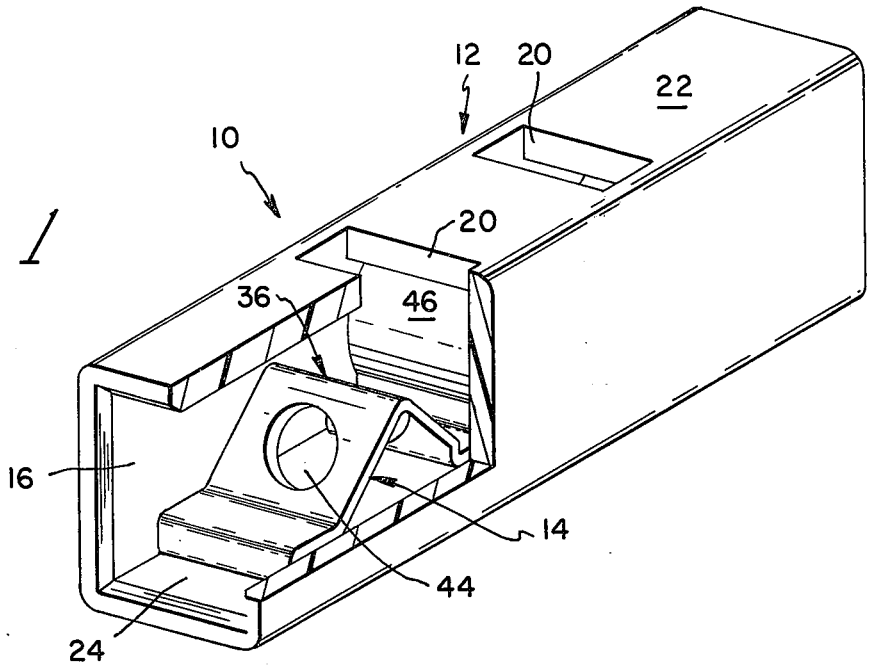
FIG. 1 is a partially sectionalized perspective drawing illustrating the preferred embodiment constructed in accordance with the principles of the present invention.

In FIG. 1 device 10 is shown in its simplest form; i.e., a single mold housing 12 and a single continuous contact strip 14. Those knowledgeable in the art will readily recognize that the unit designated as device 10 can be formed into different configurations or expanded into multi-cellular modules, all without departing from the spirit and intend of the claims appended hereto.

Housing 12 must be of an insulating material; preferably it is molded using a nylon sold under the trademark "ZYTEL 101" by the DuPont Company.

Figure 2:
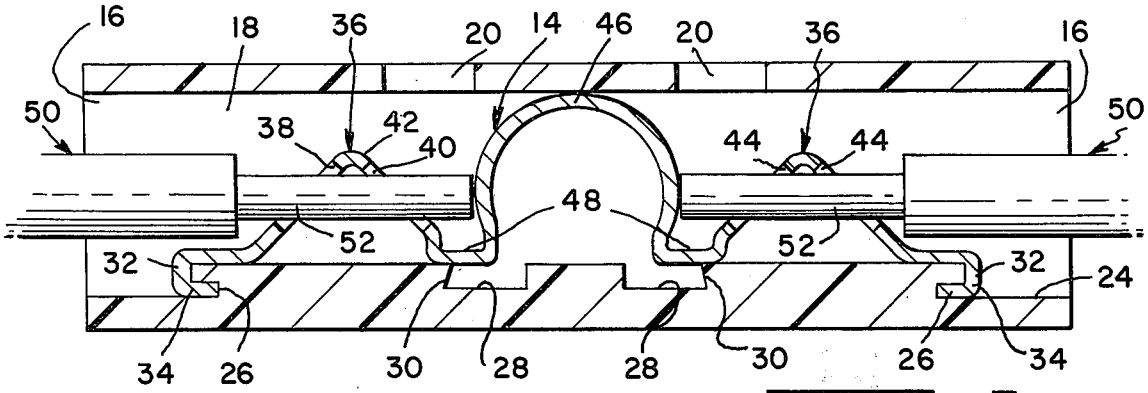
FIG. 2 is a cross-sectional view along the longitudinal axis of the device of FIG. 1 showing the insertion of wires therein.

With reference to both FIGS. 1 and 2, the housing is elongated with both ends 16 opening into passageway 18 extending throughout. A pair of ports 20 located on the top wall 22 of the housing give access to the passageway at predetermined distances inwardly from either end 16.

The interior floor 24 of housing 12 is symmetrically irregular to provide means for securing contact strip 14 therein and also to provide structural means for the strip to removably splice and retain the wires. More specifically, the means for securing contact strip 14 in the housing includes inwardly extending recesses 26, one adjacent to each end 16. As is obvious from the drawings, the vertical walls into which the recesses are molded are provided by simply increasing the vertical dimension of passageway 18 in the vicinity of each end 16.

A pair of slots 28 crossing floor 24 are located generally on either side of an imaginary line (not shown) bisecting the housing into two equal halves. The location of each slot is offset inwardly from an overlying port 20. The outside wall 30 of each slot is beveled so that the base of the slots are wider than are the openings.

Contact strip 14 is preferably stamped and formed from a coplanar sheet of conductive material such as beryllium copper. Any other conductive material having like resiliency may also be used.

Contact strip 14 is elongated with both ends 32 bent down and inwardly to form hooks 34. These hooks are received in recesses 26 in floor 24 of the housing.

The portion of contact strip 14 inwardly from each end is bent upwardly to form frames 36 having the shape of an equilateral triangle; i.e., the two walls, outside wall 38 and inside wall 40, slope away from each other at 45° relative to the apex 42. Each wall contains an aperture 44; each aperture being concentric with the other.

The center portion of contact strip 14 is formed into a semi-circular spring member 46. Intermediate the spring member and each triangle frame 36 a horizontally flat depressed step 48 is provided in the contact strip.

Dimensionally the steps 48 generally correspond in width to that of the openings of slots 28. Another critical dimension involved herein is that the length of contact strip 14 from the tip of one hook 34 to another prior to being positioned in the housing is equal to the length of floor 24 from one recess 26 to the other.

UTILIZATION OF THE PREFERRED EMBODIMENT

Two wires 50 which are to be electrically joined via device 10 have their outer insulating jackets removed to expose a short length of conductor 52.

Figure 3:
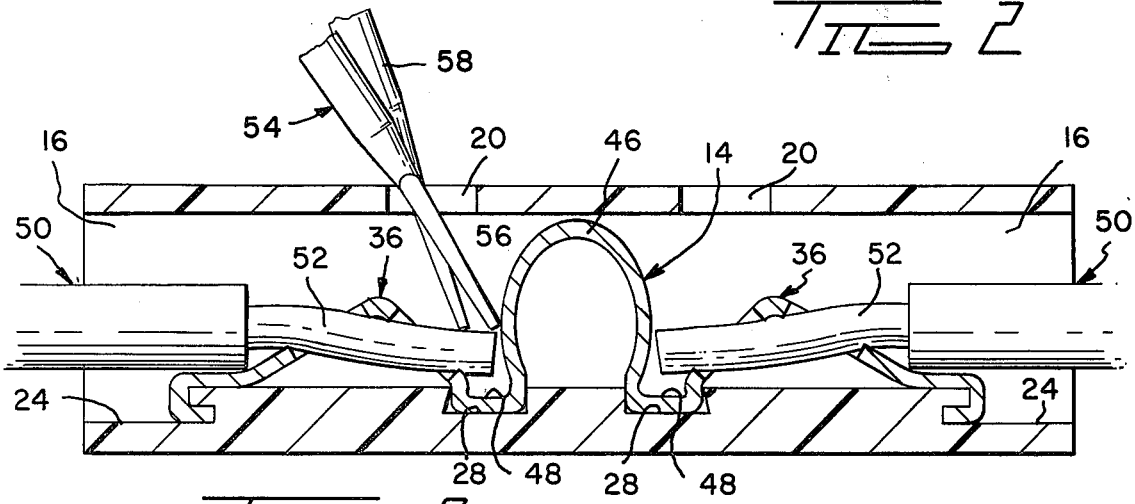
FIG. 3 is the same view as FIG. 2 with respect to the device further showing the wire locked or retained in the housing and the means for releasing them.

With reference to FIG. 2, the exposed conductors 52 are inserted into either end 16 of housing 12 and through apertures 44 in contact strip 14 until the ends thereof abut spring member 46. Inwardly directed pressure is applied on the wires until the steps 48 slide into slots 28. Referring to FIG. 3, the inwardly directed pressure exerted on spring member 46 places it in compression which biases the steps 48 against the beveled outside walls 30 of slots 28, thereby retaining them in the slots. Concurrently the triangle frames 36 are collapsed inwardly and downwardly distorting the geometry of the apertures 44 so that the edges of the walls defining them cut into conductors 52 establishing good electrical contact. In addition, the collapsed frames 36 in cooperation with the retained steps 48, secure the wires 50 in device 10 against appreciable tension.

To release a wire from device 10 a screwdriver 54, or other like tool, is inserted into passageway 18 via port 20. The tip 56 of the screwdriver pries up on spring member 46 forcing the step 48 out of slot 28. Frame 36 regains its non-stressed geometry and the wire can be easily withdrawn.

Small gauge wire which may not have sufficient ridgity to push on spring member 46 can be spliced by using a screwdriver 58 to push down on the wire and contact strip 14 thereby forcing step 48 into a locking position in slot 28.

The foregoing detailed description has been given for clearness of understanding only, and no unnecessary limitations should be understood therefrom, as some modifications will be obvious to those skilled in the art.

What is claimed is:

1. A device for electrically splicing two conductors together, which comprises:

a. a housing of insulating material and having an opened passageway throughout its length, said passageway floor having a pair of spaced apart slots;

b. a contact strip stamped and formed from a conductive material positioned in the passageway, said strip having a centrally disposed spring member and a pair of generally triangular shaped frames, one on either side of the spring member with a depressed step inbetween; and c. apertures located in each wall defining said frames, said contact strip adapted to receive a wire in each frame and upon forcing the steps into the slots with the spring member removably retaining such therein, the apertures are deformed with the edges thereof gripping the conductors thereby achieving an electrical splice between the two wires.

* * * * *